US011406243B2

(12) United States Patent
Yoo et al.

(10) Patent No.: US 11,406,243 B2
(45) Date of Patent: Aug. 9, 2022

(54) DRAINAGE DEVICE AND DISHWASHER HAVING THE SAME

(71) Applicant: SAMSUNG ELECTRONICS CO., LTD., Suwon-si (KR)

(72) Inventors: Soo Hyung Yoo, Suwon-si (KR); Sung Wook Kang, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 64 days.

(21) Appl. No.: 16/608,618

(22) PCT Filed: Mar. 28, 2018

(86) PCT No.: PCT/KR2018/003649
§ 371 (c)(1),
(2) Date: Oct. 25, 2019

(87) PCT Pub. No.: WO2018/199486
PCT Pub. Date: Nov. 1, 2018

(65) Prior Publication Data

US 2021/0113053 A1 Apr. 22, 2021

(30) Foreign Application Priority Data

Apr. 28, 2017 (KR) ..... 10-2017-0055449

(51) Int. Cl.
*A47L 15/42* (2006.01)

(52) U.S. Cl.
CPC ..... *A47L 15/4223* (2013.01); *A47L 15/4225* (2013.01); *A47L 15/4244* (2013.01); *A47L 2401/09* (2013.01)

(58) Field of Classification Search
CPC ..... A47L 15/4214; A47L 15/4219; A47L 15/4221; A47L 15/4223; A47L 15/4225;
(Continued)

(56) References Cited

U.S. PATENT DOCUMENTS 1,495,873 A * 5/1924 Schmelzer ..... F04D 29/663 415/119
1,998,338 A * 4/1935 Spohrer ..... F04B 41/02 137/565.18

(Continued)

FOREIGN PATENT DOCUMENTS

JP 9-192076 7/1997
KR 10-2004-0038214 5/2004

(Continued)

OTHER PUBLICATIONS

International Search Report dated Jul. 19, 2018, in corresponding International Patent Application No. PCT/ KR2018/003649.

(Continued)

*Primary Examiner* — David G Cormier
(74) *Attorney, Agent, or Firm* — Staas & Halsey LLP

(57) ABSTRACT

The present disclosure relates to a drainage device and a dishwasher having the same. The drainage device includes a drain pump including a drain port for discharging water, a drain pipe guiding discharge of water discharged from the drain pump, an air chamber in which the drain pump is connected to an upper portion thereof and the drain pipe is connected to a lower portion thereof, and an air pump configured to inject air into the air chamber, thereby more surely blocking the backflow of water to the drain pump by air injected into the air chamber through the air pump.

3 Claims, 6 Drawing Sheets

(58) Field of Classification Search
CPC ..... A47L 15/4244; A47L 2401/08; A47L 2401/09; D06F 39/083; D06F 39/085
See application file for complete search history.

(56) References Cited

U.S. PATENT DOCUMENTS

| | | | | |
|---|---|---|---|---|
| 3,216,255 | A * | 11/1965 | McFarlane | G01F 23/68 73/290 R |
| 3,269,318 | A * | 8/1966 | Telford | F04B 45/053 137/211.5 |
| 6,218,949 | B1 * | 4/2001 | Issachar | G01F 23/62 340/603 |
| 2004/0163689 | A1 * | 8/2004 | Lee | A47L 15/4223 134/94.1 |
| 2008/0283099 | A1 * | 11/2008 | Peukert | A47L 15/488 134/99.1 |
| 2012/0168385 | A1 * | 7/2012 | Anderson | C02F 9/00 210/703 |

FOREIGN PATENT DOCUMENTS

| | | |
|---|---|---|
| KR | 10-2007-0082616 A | 8/2007 |
| KR | 10-2011-0052776 | 5/2011 |
| KR | 10-2012-0089098 | 8/2012 |
| KR | 10-2013-0034311 | 4/2013 |

OTHER PUBLICATIONS

Written Opinion of the International Searching Authority dated Jul. 19, 2018 in corresponding International Patent Application No. PCT/ KR2018/003649.

Korean Office Action dated May 21, 2021 from Korean Application No. 10-2017-0055449.

Korean Office Action dated Nov. 27, 2021 from Korean Application No. 10-2017-0055449.

* cited by examiner

DRAINAGE DEVICE AND DISHWASHER HAVING THE SAME

CROSS-REFERENCE TO RELATED APPLICATIONS

This application is a U.S. National Stage Application which claims the benefit under 35 U.S.C. § 371 of International Patent Application No. PCT/KR2018/003649 filed on Mar. 28, 2018, which claims foreign priority benefit under 35 U.S.C. § 119 of Korean Patent Application No. 10-2017-0055449 filed on Apr. 28, 2017 in the Korean Intellectual Property Office, the contents of both of which are incorporated herein by reference.

TECHNICAL FIELD

The present disclosure relates to a drainage device for discharging water to the outside and a dishwasher having the drainage device.

BACKGROUND ART

In general, a dishwasher is a device for washing dishes by spraying water toward the dishes accommodated therein.

The dishwasher includes a main body provided with an inlet in the front surface, a door for opening and closing the inlet, a washing tub disposed inside the main body to form a washing chamber, a sump provided on a lower portion of the washing tub to collect water used in the washing tub, and a drainage device disposed at one side of the sump to discharge water to the outside of the main body.

The drainage device includes a drain pump connected to the sump and a drain pipe for guiding water pumped by the drain pump to the outside of the main body.

A check valve is disposed at a drain port of the drain pump connected to the drain pipe to prevent backflow of water, but the check valve, by its structure, cannot block a very small flow of water.

DISCLOSURE

Technical Problem

The present disclosure is directed to providing a drainage device capable of more surely blocking the backflow of water and a dishwasher having the same.

Technical Solution

One aspect of the present disclosure provides a drainage device including a drain pump including a drain port for discharging water, a drain pipe guiding discharge of water discharged from the drain pump, an air chamber in which the drain pump is connected to an upper portion thereof and the drain pipe is connected to a lower portion thereof, and an air pump configured to inject air into the air chamber.

The air pump may include a pump housing and a blowing fan installed in the pump housing.

The air pump may include a cylindrical air pump housing, a piston movably installed in the air pump housing, and an actuator configured to move the piston forward and backward.

The drainage device may further include a water level sensor configured to detect a water level in the air chamber.

The water level sensor may include a pair of electrodes disposed to be spaced apart from each other on an upper portion of the air chamber.

The water level sensor may include a light emitting portion and a light receiving portion disposed to be spaced apart from each other, a buoyancy body disposed inside the air chamber, and a guide rod moving up and down with the buoyancy body, and the guide rod may move up and down such that an upper end portion of the guide rod enters a space between the light emitting portion and the light receiving portion or escapes from the space between the light emitting portion and the light receiving portion.

The drainage device may further include a check valve disposed at the drain port to prevent backflow of water.

Another aspect of the present disclosure provides a dishwasher including a housing provided with a washing tub therein, a sump provided at a lower portion of the washing tub to collect water, and a drainage device disposed in the sump to guide water to the outside of the housing, wherein the drainage device includes a drain pump disposed at one side of the sump and including a drain port for discharging water, a drain pipe guiding discharge of water discharged from the drain pump, an air chamber in which the drain pump is connected to an upper portion thereof and the drain pipe is connected to a lower portion thereof, and an air injector configured to inject air into the air chamber.

Another aspect of the present disclosure provides a method of controlling a drainage device including confirming whether a drain pump operates, confirming a water level in an air chamber through a water level sensor when it is confirmed that the drain pump is stopped, and operating an air pump when the water level in the air chamber is higher than or equal to a set water level.

The method of controlling the drainage device may further include confirming the water level in the air chamber through the water level sensor while the air pump is in operation, and stopping the operation of the air pump when the water level is lower than the set water level.

The method of controlling the drainage device may further include operating the air pump for a set time.

Another aspect of the present disclosure provides a method of controlling a drainage device including confirming whether a drain pump operates, and operating an air pump when it is confirmed that the drain pump is stopped and stopping the operation of the air pump after a set time elapses.

The method of controlling the drainage device may further include periodically repeating the operation and stopping of the air pump.

Advantageous Effects

As described above, a drainage device and a dishwasher having the same include an air chamber disposed between a drain pump and a drain pipe and an air pump for injecting air into the air chamber, so that the backflow of water to the drain pump can be more surely blocked by air injected into the air chamber through the air pump.

MODE OF THE INVENTION

Figure 1:
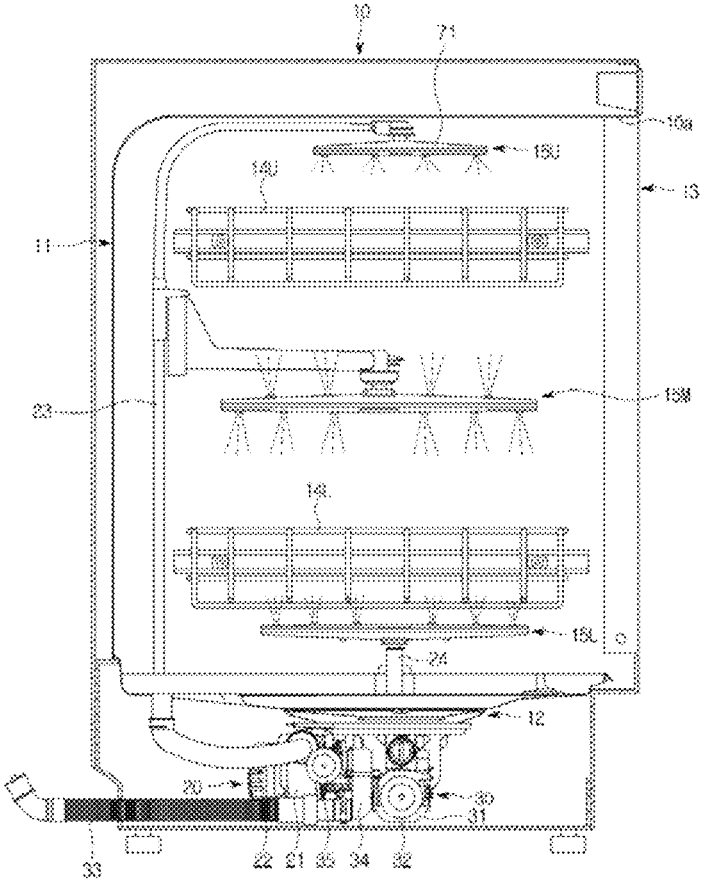
FIG. 1 is a cross-sectional view of a dishwasher to which a drainage device according to an embodiment of the present disclosure is applied.

The embodiments described herein and the configurations shown in the drawings are only examples of preferred embodiments of the present disclosure, and various modifications may be made at the time of fling of the present disclosure to replace the embodiments and drawings of the specification.

Like reference numbers or signs in the various figures of the present application represent parts or components that perform substantially the same functions.

The terms used herein are for the purpose of describing the embodiments and are not intended to limit the present disclosure. For example, the singular expressions herein may include plural expressions, unless the context clearly dictates otherwise. The terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another.

For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front," "rear," "upper," "lower," "left," and "right" are defined with reference to the drawings, and the shape and position of each component are not limited by these terms.

Hereinafter, a dishwasher to which a drainage device according to an embodiment of the present disclosure is applied will be described in detail with reference to the accompanying drawings.

As illustrated in FIG. 1, a dishwasher including a drainage device according to an embodiment of the present disclosure includes a main body 10 forming an outer appearance and having an inlet 10*a* formed on the front surface, a washing tub 11 provided inside the main body 10 to wash dishes, a sump 12 provided at a lower portion of the washing tub 11 to collect water used for washing, and a door 13 for opening and closing the inlet 10*a*.

The washing tub 11 is provided with a pair of racks 14U and 14L arranged vertically to accommodate dishes and a plurality of nozzles 15U, 15M and 15L for spraying water toward the dishes accommodated in the pair of racks 14U and 14L.

The pair of racks 14U and 14L include the upper rack 14U disposed at an upper portion of the washing tub 11 and the lower rack 14L disposed at a lower portion of the washing tub 11, and the plurality of nozzles 15U, 15M and 15L includes the upper nozzle 15U disposed at an upper side of the upper rack 14U to spray water downward, the intermediate nozzle 15M disposed between the upper rack 14U and the lower rack 14L to spray water upward and downward, and the lower nozzle 15L disposed at a lower side of the lower rack 14L to spray water upward.

The sump 12 is provided to be recessed on the lower portion of the washing tub 11 to collect water used in the washing tub 11. The sump 12 is provided with a circulation device 20 for circulating water collected in the sump 12 and a drainage device 30 for discharging water collected in the sump 12 to the outside of the main body 10 of the dishwasher.

The circulation device 20 includes a circulation pump 21 for pumping water collected in the sump 12, a circulation motor 22 for driving the circulation pump 21, a first supply pipe 23 connected to the upper nozzle 15U and the intermediate nozzle 15M to deliver water pumped by the circulation pump 21 to the upper nozzle 15U, and a second supply pipe 24 connected to the lower nozzle 15L to deliver water pumped by the circulation pump 21 to the lower nozzle 15L.

Figure 2:
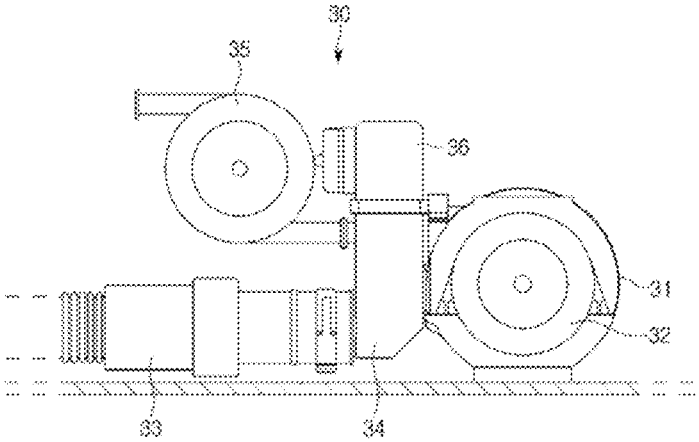
FIG. 2 is a side view of the drainage device according to an embodiment of the present disclosure.
Figure 3:
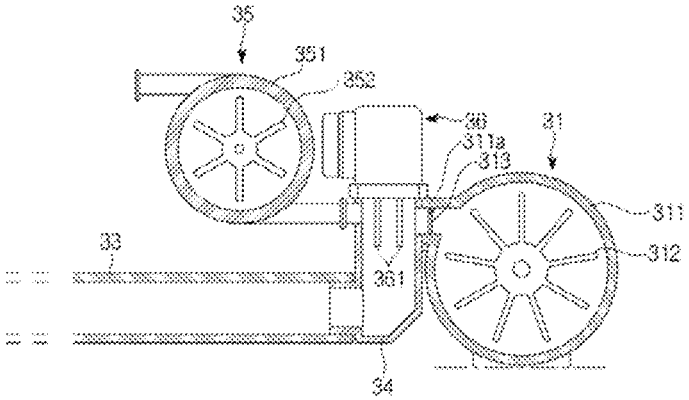
FIG. 3 is a schematic view illustrating an internal configuration of the drainage device according to an embodiment of the present disclosure.

As illustrated in FIGS. 2 and 3, the drainage device 30 includes a drain pump 31 for pumping water collected in the sump 12, a drain motor 32 for driving the drain pump 31, and a drain pipe 33 for guiding water pumped by the drain pump 31 to the outside of the main body 10.

The drain pump 31 includes a drain pump housing 311 provided with a drain port 311*a* on one side thereof, and an impeller 312 disposed in the drain pump housing 311 to pump water by rotation. Therefore, as the impeller 312 rotates, water is sucked from the sump 12 and discharged through the drain port 311*a*.

One end of the drain pipe 33 is connected to a lower side of an air chamber 34, which will be described later, and although not shown in the drawings, an intermediate portion of the drain pipe 33 is formed to have an inverted U shape.

A check valve 313 is disposed on the drain port 311*a* to prevent backflow of water, so that discharge of water through the drain port 311*a* is allowed while backflow of water through the drain port 311*a* may be prevented.

The drainage device 30 further includes an air chamber 34 for more surely blocking the backflow of water to the drain pump 31 and an air pump 35 for injecting air into the air chamber 34.

The air chamber 34 is disposed vertically between the drain pump 31 and the drain pipe 33, and the drain port 311*a* of the drain pump 31 is connected to an upper portion of the air chamber 34, and the drain pipe 33 is connected to a lower portion of the air chamber 34.

The air pump 35 is connected to an upper side of the air chamber 34 to inject air into the upper side of the air chamber 34. In the present embodiment, the air pump 35 includes an air pump housing 351 forming an outer appearance, and a blowing fan 352 rotatably installed in the air pump housing 351.

The drainage device 30 further includes a water level sensor 36 installed in the air chamber 34 to measure a water level in the air chamber 34. In the present embodiment, the water level sensor 36 includes a pair of electrodes 361 disposed at the upper portion of the air chamber 34 and spaced apart from each other.

Although not shown in the drawings, the dishwasher includes a controller for controlling the aforementioned internal components. The controller receives a signal from the water level sensor 36 to operate and stop the air pump 35.

A control method of the drainage device of the dishwasher configured as described above will be described below.

When the washing of dishes is completed, the drain motor 32 is operated, and the impeller 312 of the drain pump 31 rotates according to the operation of the drain motor 32. Accordingly, the water collected in the sump 12 is sucked into the drain pump 31 and passes through the drain port 311*a*, the air chamber 34 and the drain pipe 33 in order, and then is discharged to the outside of the main body 10 of the dishwasher.

When the operation of the drain motor 32 is stopped after the drainage of a predetermined amount or more of water is completed, part of the water that has passed through the drain pipe 33 formed in the inverted U shape may flow back to the drain pump 31. However, because the check valve 313 is disposed at the drain port 311*a* of the drain pump 31, the backflow of water is suppressed.

When the drainage is completed, the controller confirms whether the drain pump 31 operates. When it is confirmed that the operation of the drain pump 31 is stopped, the controller operates the air pump 35. Air is injected into the air chamber 34 by the operation of the air pump 35, and the water level is lowered as water is pushed downward by an increase in the pressure inside the air chamber 34. Therefore, the drain port 311*a* and the drain pipe 33 are separated from each other by air, and the backflow of water to the drain pump 31 is more surely suppressed.

As such, because part of the air inevitably leaks to the drain pump 31 through the check valve 313 in a state where the air is filled in the upper portion of the air chamber 34, the pressure inside the air chamber 34 gradually decreases and thus the water level inside the air chamber 34 becomes high again.

As the water level in the air chamber 34 increases, a current flows through the water between two of the electrodes 361 of the water level sensor 36, and thus the water level sensor 36 detects that the water level is higher than or equal to a set water level.

When it is detected through the water level sensor 36 that the water level is higher than or equal to the set water level, the controller operates the air pump 35 to inject air into the air chamber 34. Therefore, the pressure inside the air chamber 34 again increases, and the water level inside the air chamber 34 is lowered again.

As described above, when the water level in the air chamber 34 is lower than the set level while the air pump 35 is in operation, the current flowing between two of the electrodes 361 of the water level sensor 36 is blocked. Accordingly, the controller confirms that the water level in the air chamber 34 is lower than the set water level and stops the operation of the air pump 35.

In the present embodiment, the controller continuously confirms the water level in the air chamber 34 through the water level sensor 36 to operate or stop the air pump 35 according to the confirmed water level in the air chamber 34.

Therefore, the backflow of water to the drain pump 31 is firstly suppressed by the check valve 313 and suppressed again through the air chamber 34 and the air pump 35, so that the backflow of water to the drain pump 31 is more surely blocked.

In present embodiment, the controller continuously confirms the water level in the air chamber 34 through the water level sensor 36 to operate and stop the air pump 35, but the present disclosure is not limited thereto. As another control method, the controller may operate the air pump 35 for a set time and then stop the operation of the air pump 35 after the set time has elapsed.

Figure 4:
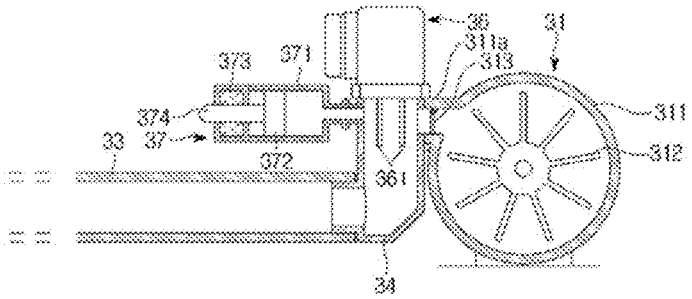
FIG. 4 is a schematic view illustrating an internal configuration of a drainage device according to another embodiment of the present disclosure.

In present embodiment, the air pump 35 includes the blowing fan 352, but is not limited thereto. As illustrated in FIG. 4, an air pump 37 may include a cylindrical air pump housing 371, a piston 372 installed in the air pump housing 371 to be movable forward and backward, and an actuator 374 moving forward and backward by a solenoid 373 to move the piston 372. In addition, air may be injected into the air chamber 34 through various types of air pumps.

Figure 5:
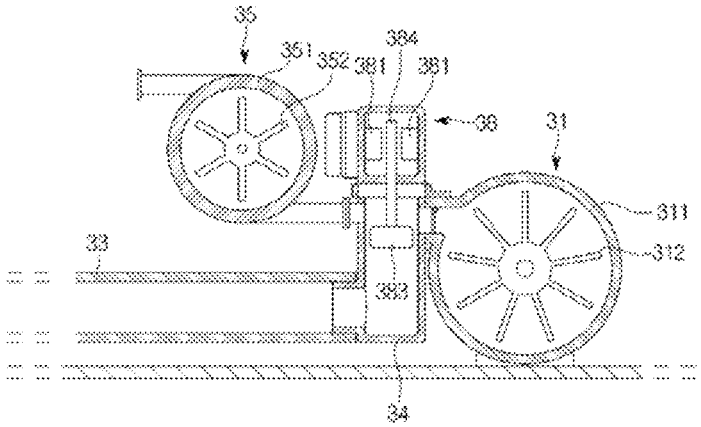
FIG. 5 is a schematic view illustrating an internal configuration of a drainage device according to another embodiment of the present disclosure.

In the present embodiment, the water level sensor 36 includes the pair of electrodes 361 to detect whether the water level is higher than or equal to the set water level through the flow of current between two of the electrodes 361, but the present disclosure is not limited thereto. As illustrated in FIG. 5, a water level sensor 38 may include a light emitting portion 381 and a light receiving portion 382 disposed to be spaced apart from each other, a buoyancy body 383 disposed inside the air chamber 34 to move up and down according to the water level, and a guide rod 384 extending upward from the buoyancy body 383 to guide the vertical movement of the buoyancy body 383.

As the guide rod 384 moves up and down with the buoyancy body 383, an upper end portion of the guide rod 384 enters a space between the light emitting portion 381 and the light receiving portion 382 or escapes from the space between the light emitting portion 381 and the light receiving portion 382. Accordingly, the light irradiated from the light emitting portion 381 is selectively transmitted to the light receiving portion 382 according to the position of the upper end portion of the guide rod 384, and through this, it may be detected whether the water level in the air chamber 34 is equal to or higher than the set water level.

In the present embodiment, the drainage device 30 includes the water level sensor 36 to operate the air pump 35 when the water level is higher than or equal to the set water level, but it is only one example, and the air pump 35 may be operated without the configuration corresponding to the water level sensor 36. That is, the controller may perform processes of confirming whether the drain pump 31 operates, operating the air pump 35 when it is confirmed that the operation of the drain pump 31 is stopped, and stopping the operation of the air pump 35 after the set time elapses.

Figure 6:
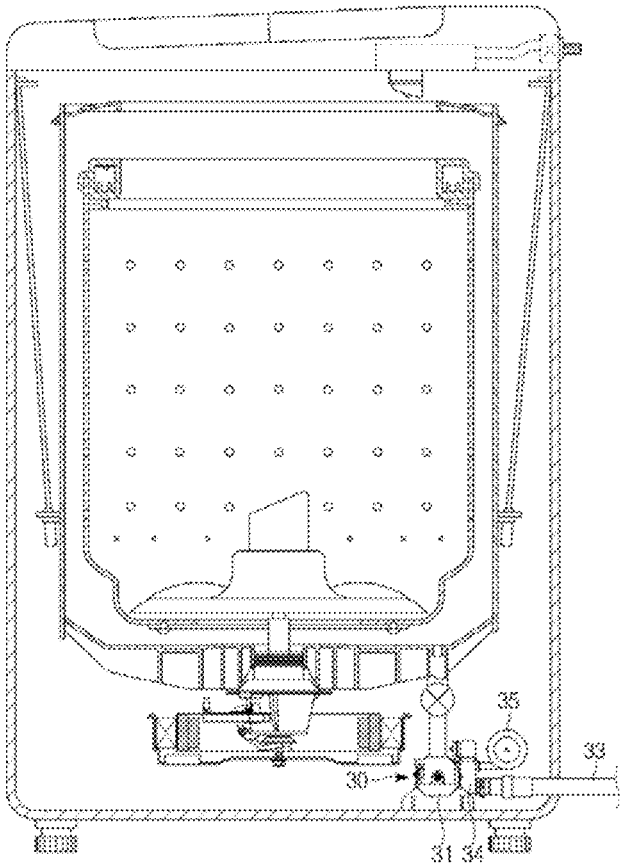
FIG. 6 is a cross-sectional view of a clothes washing machine to which the drainage device according to an embodiment of the present disclosure is applied.

As described above, in consideration of the point that the water level of the air chamber 34 may increase with time, the controller causes the operation of the drain pump 31 and the stop of the drain pump 31 to be repeatedly performed periodically. In the present embodiment, an example in which the drainage device 30 is applied to the dishwasher has been described, but the present disclosure is not limited thereto. For example, as illustrated in FIG. 6, the drainage device 30 including the air chamber 34 and the air pump 35 may be applied to a clothes washing machine.

While the present disclosure has been particularly described with reference to exemplary embodiments, it should be understood by those of skilled in the art that various changes in form and details may be made without departing from the spirit and scope of the present disclosure.

The invention claimed is:

1. A drainage device comprising:

a drain pump including a drain port for discharging water;

a drain pipe guiding discharge of water discharged from the drain pump;

an air chamber disposed between the drain pump and the drain pipe such that the drain port of the drain pump is connected to an upper portion of the air chamber and the drain pipe is connected to a lower portion of the air chamber;

an air pump configured to inject air into the air chamber;

a water level sensor disposed at the upper portion of the air chamber to detect whether a water level is higher than or equal to a set water level;

a controller configured to operate the air pump based on the water level detected through the water level sensor; and a check valve disposed at the drain port to prevent backflow of water to the drain pump, wherein the air pump is connected to the upper portion of the air chamber to inject air into the upper portion of the air chamber to lower the water level below the set water level and to prevent backflow of water to the drain pump, and wherein the water level sensor includes a pair of electrodes disposed to be spaced apart from each other on the upper portion of the air chamber and lower ends of the pair of electrodes are positioned lower than the drain port.

2. The drainage device according to claim 1, wherein the air pump includes a pump housing and a blowing fan installed in the pump housing.

3. The drainage device according to claim 1, wherein the air pump includes a cylindrical air pump housing, a piston movably installed in the air pump housing, and an actuator configured to move the piston forward and backward.

* * * * *